US007955142B1

(12) United States Patent
Shuey et al.

(10) Patent No.: US 7,955,142 B1
(45) Date of Patent: Jun. 7, 2011

(54) ROTATABLE SECONDARY LOCK FOR ELECTRICAL CONNECTOR

(75) Inventors: John Raymond Shuey, Mechanicsburg, PA (US); Galen M Martin, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/657,391

(22) Filed: Jan. 20, 2010

(51) Int. Cl.
*H01R 13/514* (2006.01)

(52) U.S. Cl. ..... 439/752

(58) Field of Classification Search ..... 439/752
See application file for complete search history.

(56) References Cited

U.S. PATENT DOCUMENTS

| | | | | |
|---|---|---|---|---|
| 4,698,030 | A * | 10/1987 | Ryll et al. | 439/752 |
| 4,973,266 | A | 11/1990 | Bullard | |
| 5,647,776 | A * | 7/1997 | Duclos et al. | 439/752 |
| 6,036,553 | A * | 3/2000 | Seko et al. | 439/752 |
| 6,945,829 | B2 * | 9/2005 | Finzer et al. | 439/752 |

* cited by examiner

*Primary Examiner* — Tho D Ta

(57) ABSTRACT

An electrical connector assembly is comprised of a main housing portion and a front housing portion. The main housing portion and front housing portion receive a terminal therethrough and are rotatable relative to each other. The front housing portion has a terminal receiving cavity which receives the base portion of a terminal, and the main housing portion has a terminal receiving passageway. The terminal receiving passageway has a terminal receiving aperture which aligns with the terminal receiving cavity, which when rotated overlaps the terminal receiving cavity to lock the terminal therein.

18 Claims, 9 Drawing Sheets

ROTATABLE SECONDARY LOCK FOR ELECTRICAL CONNECTOR

FIELD OF THE INVENTION

This invention is related to electrical connectors used to connect wires, such as connectors used in an automotive electrical or electronic system. This invention is also related to electrical connectors employing primary and secondary locks and to sealed electrical connectors.

DESCRIPTION OF THE PRIOR ART

Although it is important for electrical connectors in all applications to establish a reliable electrical termination that will not be disengaged under normal operating conditions, automotive applications tend to have the most difficulties. The failure of electrical connectors in automotive applications is not only due to the environment in which the connectors are used, but many problems have been traced to errors in assembling the electrical connectors and the harness in which they are employed. With the increased use of electronics in automotive applications these problems can be compounded simply because of the additional circuits and wires that must be joined by the electrical connector.

To overcome these problems, electrical connectors used in automotive applications have used secondary or redundant locking to prevent terminals from being disengaged from the molded housings in which multiple terminals are mounted. One inherent problem with secondary or redundant locking schemes is that they inevitably take up space. With the increasing number of wires and circuits that must be connected, space often becomes critical. Many electrical connectors have a large number of terminals densely packed in a small space. It is also common to house terminals of different size in the same male or female electrical connector.

For example, terminals for supplying electrical power to components in an automobile are commonly housed in the same electrical connector with a large number of terminals connecting signal wires. Each terminal in electrical connectors of this type is typically held in position by a molded resilient primary latch engaging the terminal in its terminal cavity and a secondary or redundant locking member is used either to ensure that the resilient latch does not become disengaged or to independently hold the terminals in the electrical connector.

U.S. Pat. No. 6,004,158 discloses an electrical connector assembly that addresses some of these problems, but the male and female electrical connectors forming that connector assembly are not sealed or waterproof. The use of sliding plate secondary locks with connectors that are sealed at the mating interface and around each wire entering the connector imposes additional problems not addressed by the design of that prior art connector.

It is an object to improve upon these and other shortcomings of the prior art.

SUMMARY OF THE INVENTION

The objects have been accomplished by providing an electrical connector assembly, comprising a main housing portion having a terminal receiving passageway therethrough; a front housing portion having a terminal receiving cavity therein; and an electrical terminal receivable through the terminal receiving passageway and receivable into the terminal receiving cavity. The main housing portion and the front housing portion are movable relative to each other causing an overlap of the terminal receiving passageway and the terminal receiving cavity.

In another embodiment, an electrical connector assembly, comprises a main housing portion having a terminal receiving passageway therethrough; and a front housing portion. The main housing portion and the front housing portion are movable relative to each other causing an overlap of the terminal receiving passageway and the front housing portion, providing a secondary lock for a terminal.

Finally, in another embodiment, a single position electrical connector assembly comprises a main housing portion having a terminal receiving passageway therethrough; and a front housing portion has a terminal receiving cavity therein, longitudinally aligned with the terminal receiving passageway. The main housing portion and the front housing portion are movable relative to each other causing an overlap of the terminal receiving passageway and the terminal receiving cavity, providing a secondary lock for a terminal.

DETAILED DESCRIPTION OF THE EMBODIMENTS

Figure 1:
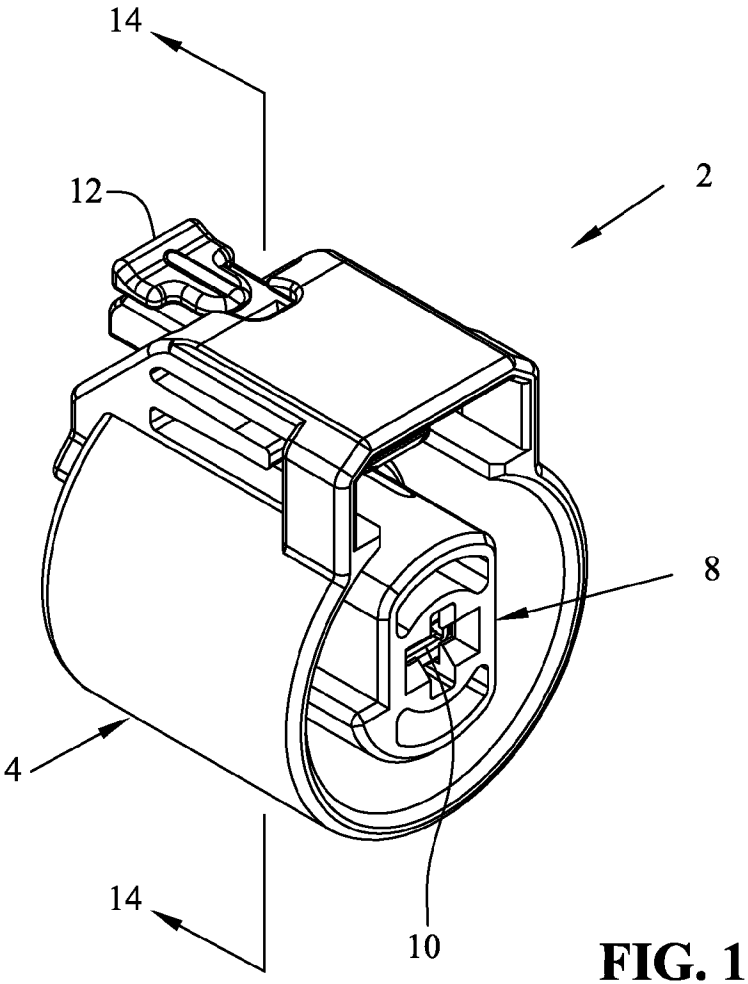
FIG. 1 is a front perspective view of the connector assembly of the present embodiment.
Figure 2:
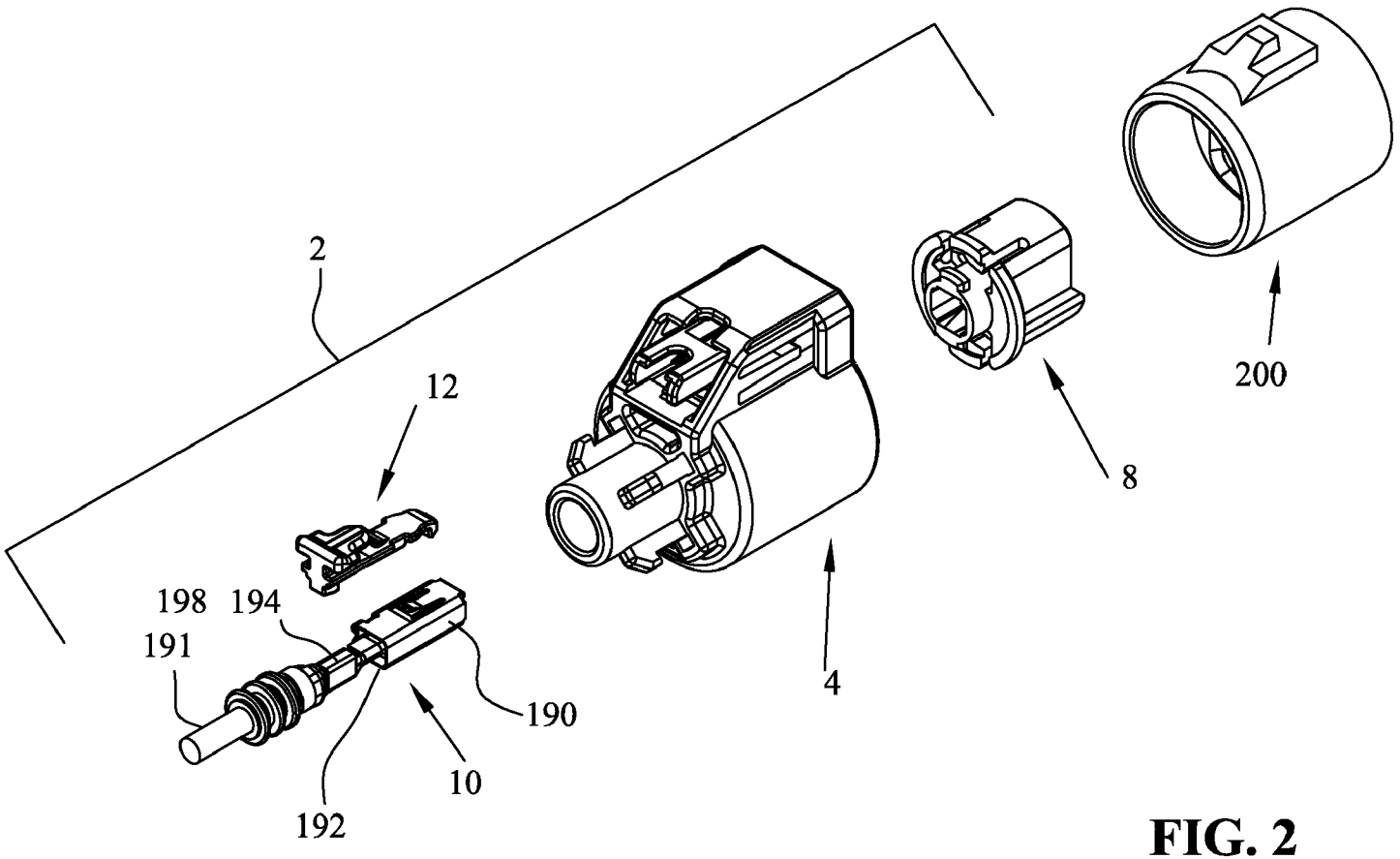
FIG. 2 is an exploded view of the connector assembly of FIG. 1.

With reference first to FIGS. 1 and 2, an electrical connector assembly is shown at 2 including a main housing portion 4, a front housing portion 8, a terminal 10, and a locking latch backup 12. As shown, all of the components of the electrical connector 2 are shown poised for electrical connection with a mating connector shown generally at 200. It should be understood that the mating connector 200 is shown only diagrammatically, but would be the type of connector having an electrical terminal positioned therein.

Figure 3B:
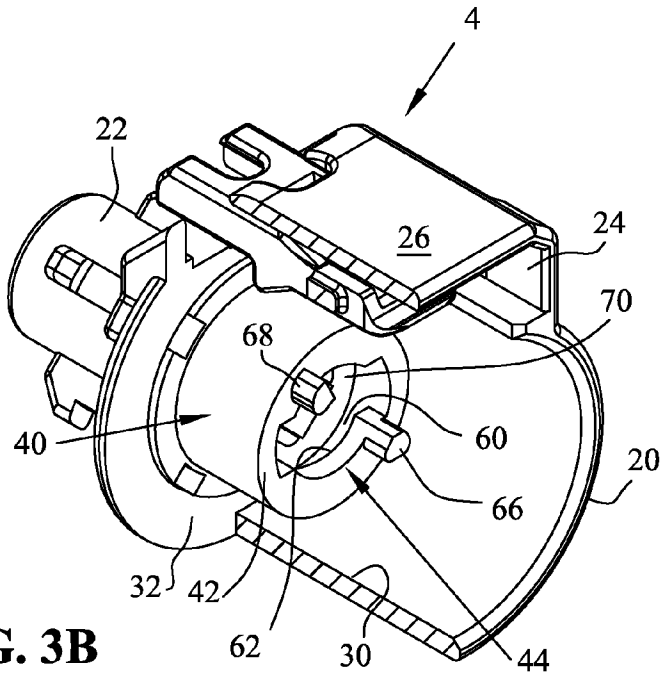
FIG. 3B is a view similar to that of FIG. 3A showing the main housing portion in partial fragmentation.
Figure 3A:
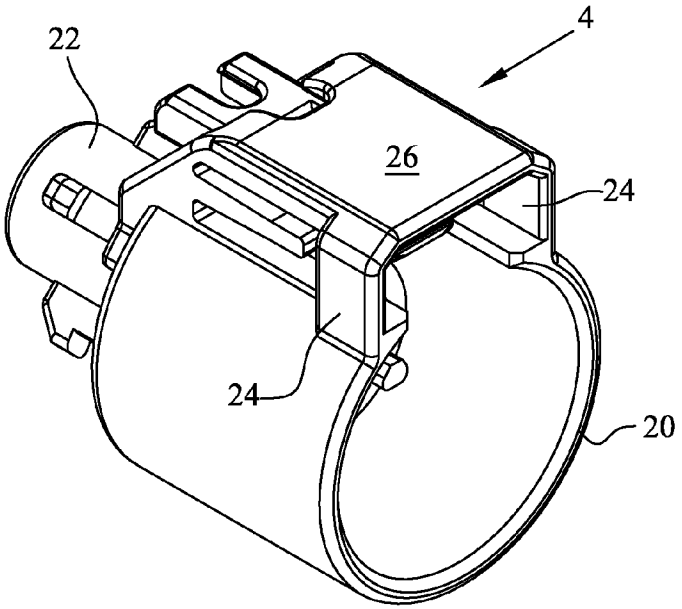
FIG. 3A is a front perspective view of the main housing portion of the connector assembly of FIGS. 1 and 2.
Figure 4:
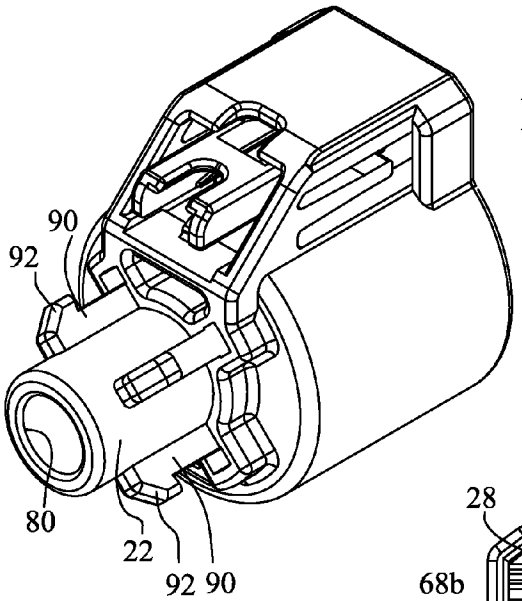
FIG. 4 is a rear perspective view of the main housing portion of FIG. 3A.
Figure 5:
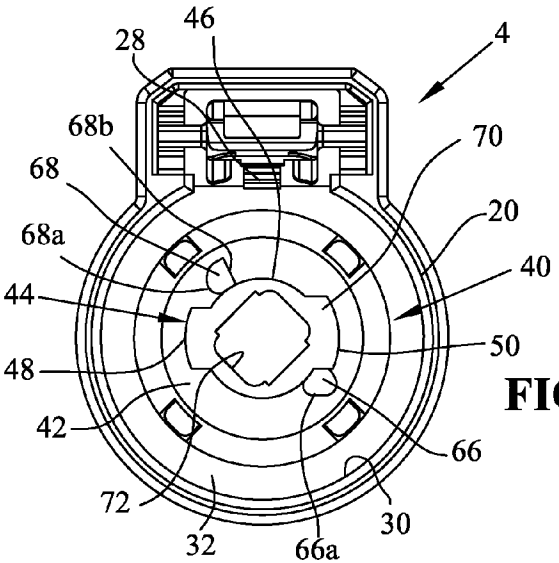
FIG. 5 is a front, plan view of the main housing portion of FIG. 3A.
Figures 7, 8:
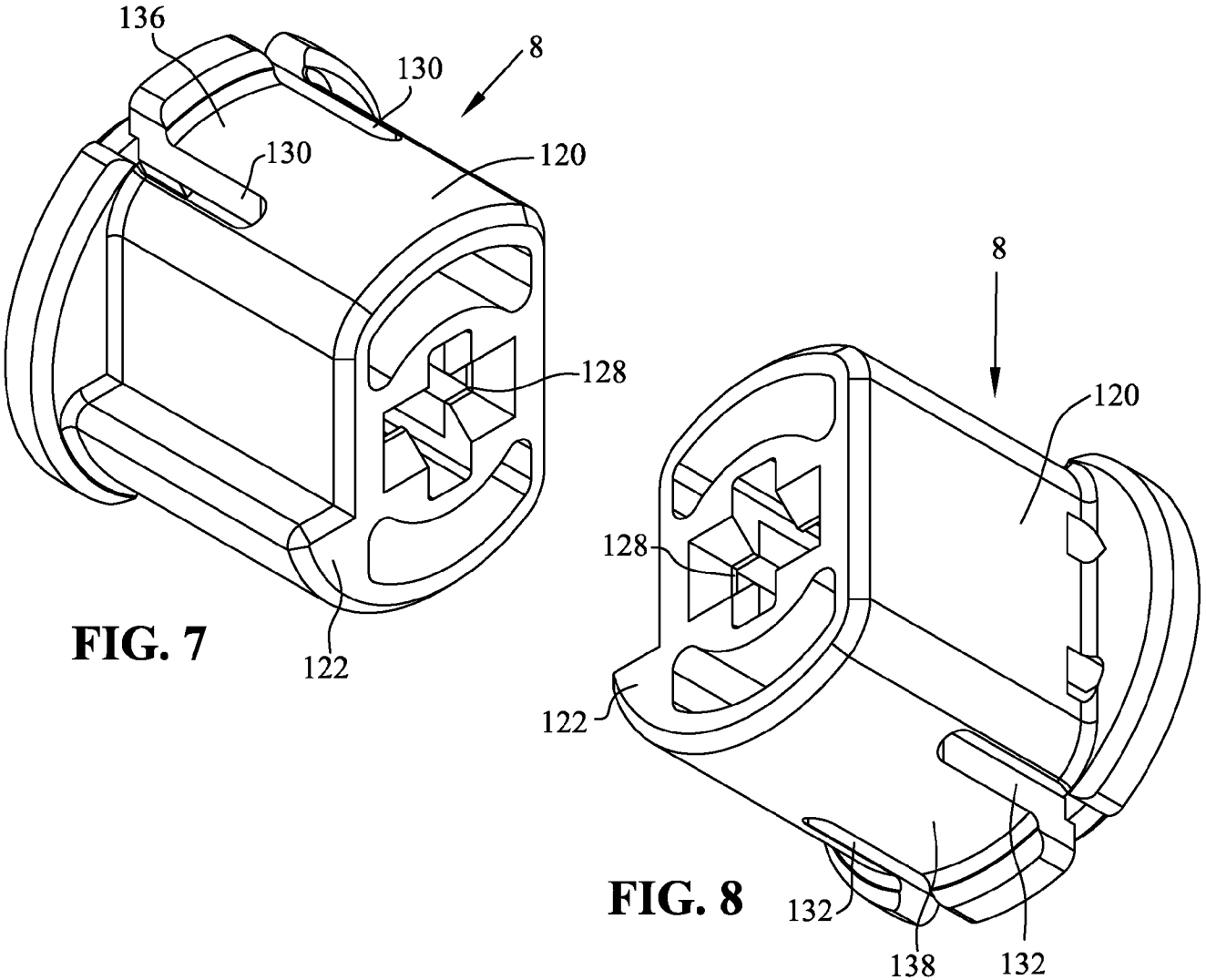
FIGS. 7 and 8 show front perspective views of the front housing portion.

With reference now to FIGS. 3A-6, the main housing portion 4 will be described in greater detail. With reference first to FIG. 3A, main housing portion 4 is comprised of a front cylindrical housing portion 20 which would generally be profiled for complementary engagement with mating connector 200, and further comprises a rear cylindrical portion 22 generally profiled to receive terminal 10 therethrough. Main housing portion 4 further comprises upstanding walls 24 on either side thereof together with a top wall 26 which together define an area for locking latch 28 (FIG. 5). As shown best in FIGS. 3B and 5, front cylindrical portion 20 includes an inner cylindrical surface 30 which extends rearwardly to a forwardly facing rear wall 32.

Main housing portion 4 also includes a central post portion 40 extending forwardly from forwardly facing wall 32 having a front face at 42. Front face 42 includes a bayonet-style locking member at 44 having a central opening 46 (FIG. 5) and transverse openings 48 and 50. It should be appreciated that transverse openings 48 and 50 are differently configured for polarization. As shown best in FIG. 3B, transverse openings 48 and 50 communicate with a groove 60 defining a rear face 62. Post 40 also includes locking lugs 66 and 68 where each of the locking lugs 66, 68 have detent surfaces 66*a*, 68*a*, respectively, and locking lug 68 has a locking surface 68*b*.

Figure 6:
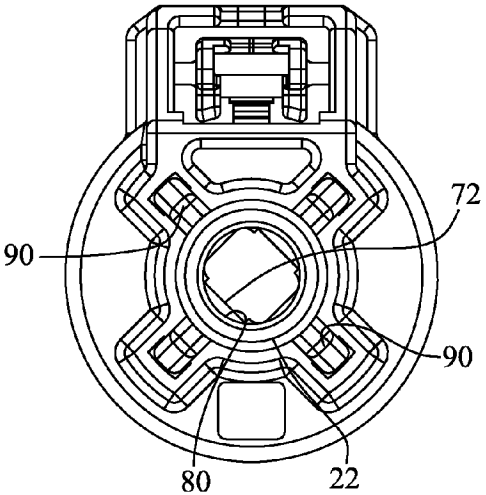
FIG. 6 is a rear plan view of the main housing portion.

With reference now to FIGS. 3B and 5, main housing portion 4 also includes a rear wall 70 which communicates with a terminal receiving passageway 80. Terminal receiving passageway 80 has a generally rectangular terminal receiving aperture 72 extending therethrough. Aperture 72 extends through wall 70, as best shown in FIGS. 4 and 6. Rear cylindrical portion 22 also includes a plurality of ribs 90 having locking members 92 as described herein.

Figure 12:
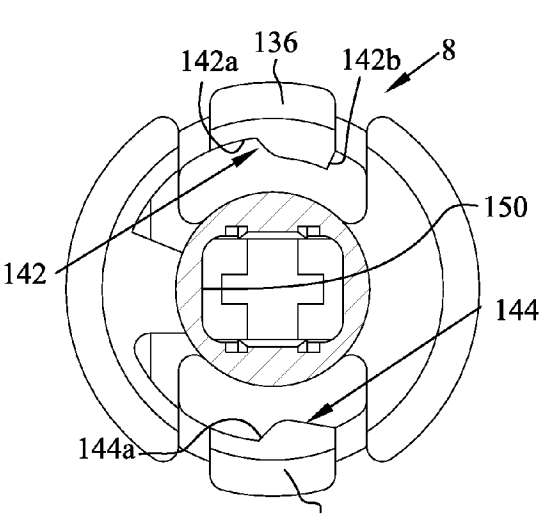
FIG. 12 shows a cross-sectional view taken through the front housing portion at lines 12-12 of FIG. 9.

With reference now to FIGS. 7-11, the front housing portion 8 is shown having a front body portion 120 with a front face 122, a rear face at 124, and a rear central post at 126. Front face 122 has a mating terminal receiving opening at 128 which is shown for receipt of a blade-type terminal. Body portion 120 has slots at 130, 132 (FIGS. 7 and 8) defining upper and lower flexible arms 136, 138, respectively. Locking members 142 and 144 are integrated with the flexible arms 136, 138, respectively, and as shown best in FIG. 12, arms 136 and 138 have detent portions at 142*a* and 144*a*, respectively, and arm 136 has a locking surface at 142*b*.

Figure 11:
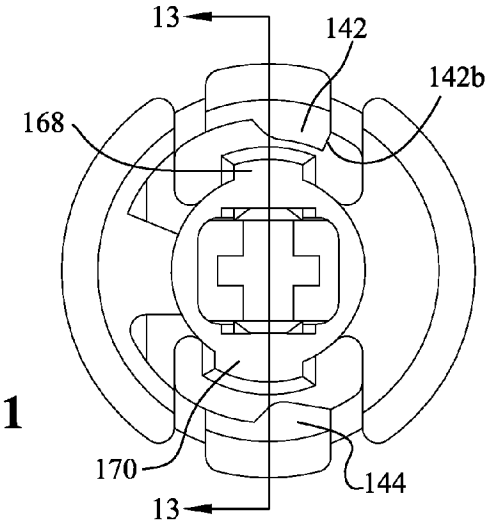
FIG. 11 shows a rear plan view of the front housing portion of FIGS. 9 and 10.
Figure 9:
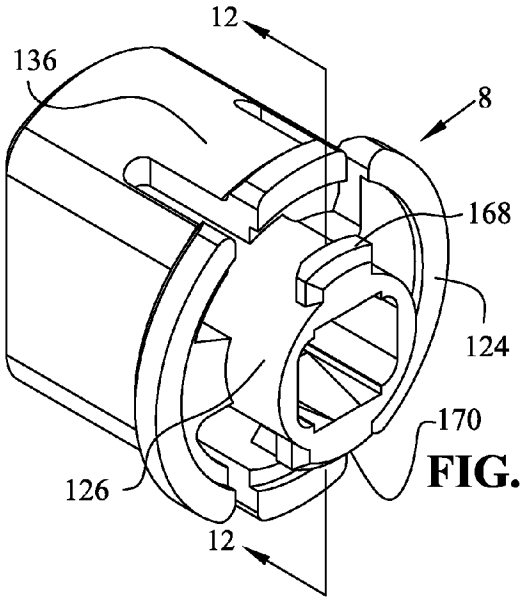
FIGS. 9 and 10 show rear perspective views of the front housing portion.
Figure 10:
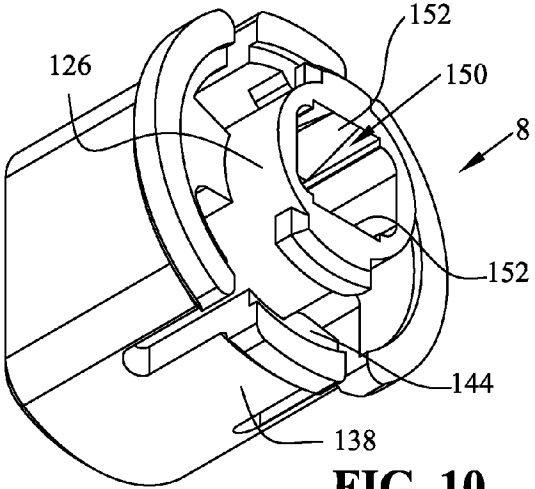
Figure 13:
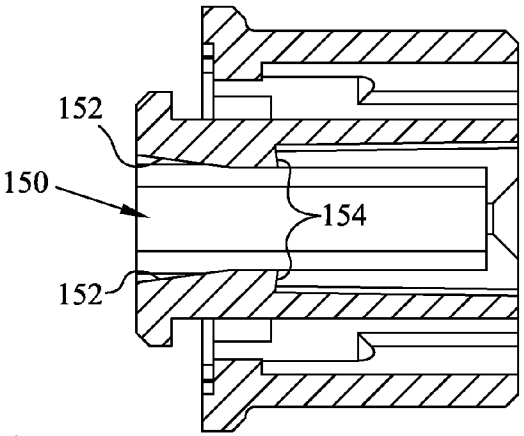
FIG. 13 is a cross-sectional view through lines 14-14 of FIG. 11.

As shown best in FIGS. 10 and 13, central post 126 also includes a terminal receiving cavity at 150 having ramped surfaces at 152 which extend inwardly to define forwardly facing locking surfaces 154 (FIG. 13). Finally, post 126 includes transverse locking tabs 168 and 170 which correspond with openings 48 and 50 as described herein. As best shown in FIG. 11, transverse locking tabs are also differently configured for polarized connection with transverse openings 48 and 50, as described herein.

As shown in FIG. 2, terminal 10 includes a box-shaped base portion 190 having a rear locking edge 192. Terminal 10 also includes a crimp portion 194 which terminates to a conductor of wire 196. Seal 198 is positioned over wire 196. As shown best in FIG. 16, a seal 210 is positionable over post 40.

Figure 15:
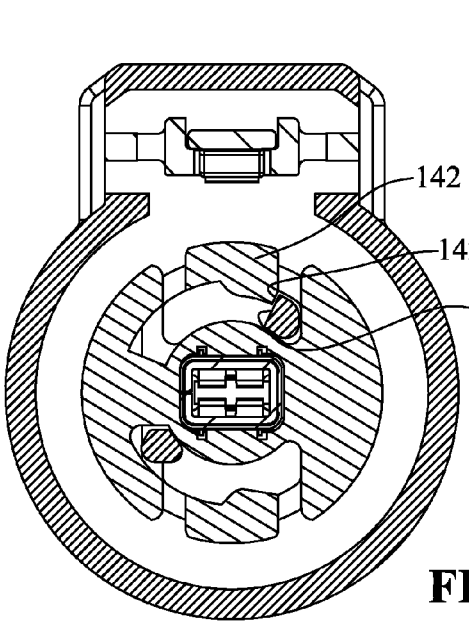
FIG. 15 is a cross-sectional view similar to that of FIG. 13 showing the front housing portion in the locked position.
Figure 14:
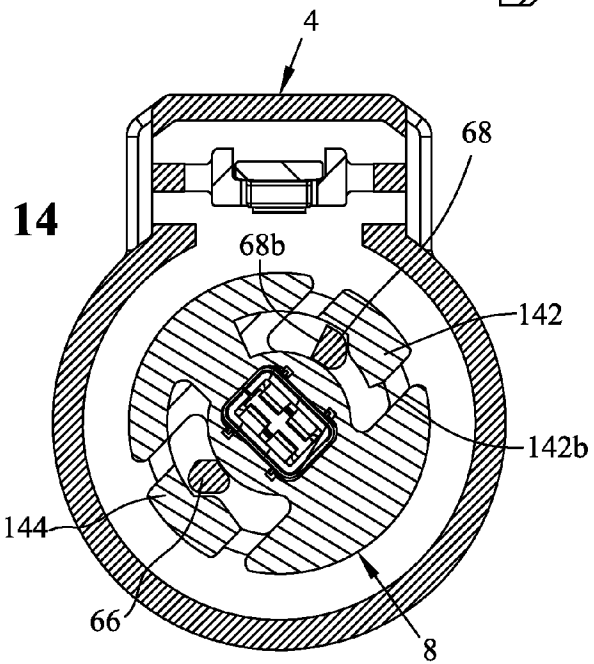
FIG. 14 is a cross-sectional view of the connector assembly taken through lines 13-13 of FIG. 1 with the terminal in the fully inserted position but with the front housing portion in a pre-locked condition.
Figure 16:
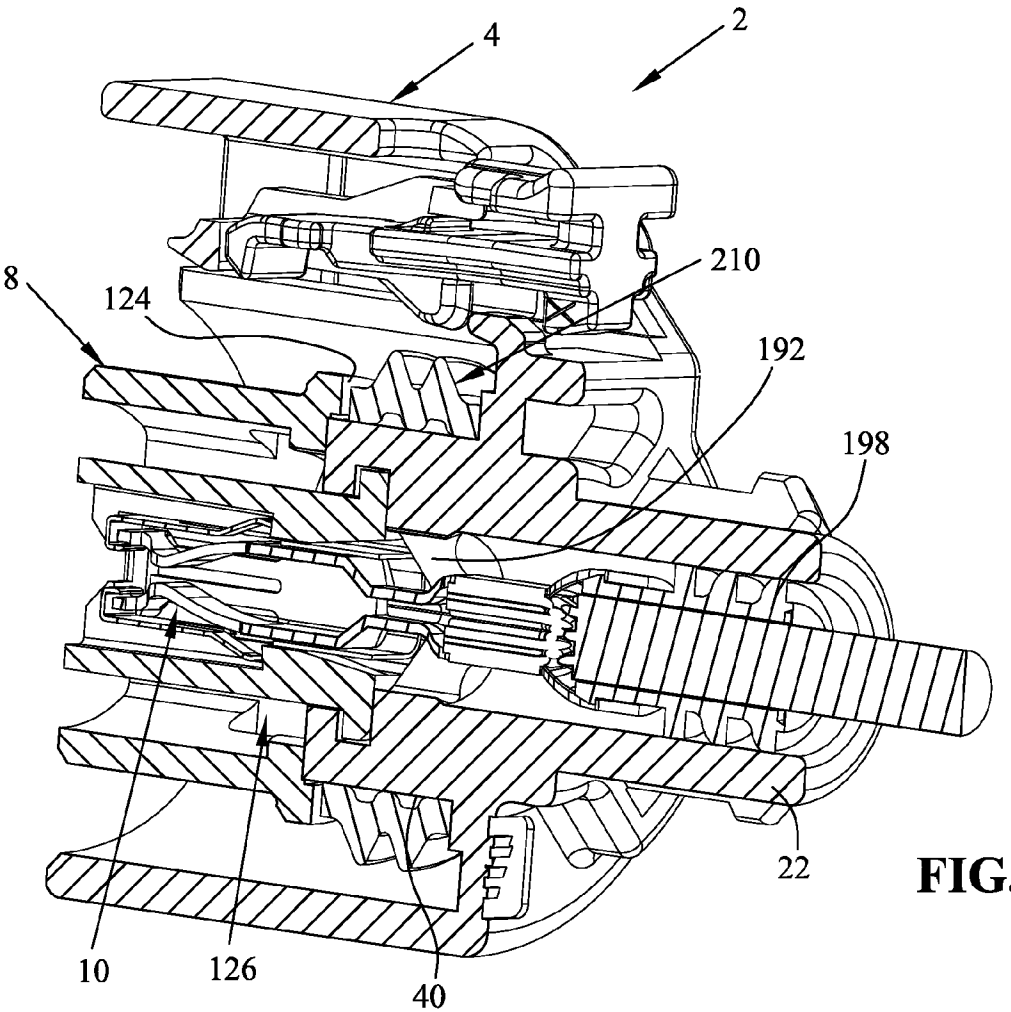
FIG. 16 is a longitudinal cross-section through the connector of FIG. 1 with the front housing portion in the position of FIG. 15.

To assemble the connector assembly, the transverse locking tabs 168, 170, (FIG. 9) are insertable into the corresponding transverse openings 48, 50 (FIG. 5) which positions the lugs 66, 68 in a nested position with respect to arms 142, 144 as shown best in FIG. 14. In this position, the terminal receiving cavities 150 and terminal receiving apertures 72 are also in alignment. In this position, terminal 10 may be received through rear cylindrical member 22 into a latched position as shown in FIG. 16. Main housing member 4 may now be rotated clockwise (or front housing portion 8 is rotated counter-clockwise) as viewed in FIG. 14 to the position shown in FIG. 15 where locking surface 68*b* of lug 68 locks behind surface 142*b*. This locks the front housing portion relative to main housing portion 4, as transverse locking tabs rotate into the groove 60 (FIG. 3B). As the box-shaped portion of terminal 10 is situated in central post section 26, with the interface of apertures 72 and cavities 150 coincident with rear edge 192, the rotation of main housing portion 4 relative to the front housing portion 8 causes the rotational shifting or twisting of the two rectangular openings about a longitudinal centerline, thereby placing corners of aperture 72 over the rear edges 192 of terminal 10 locking terminal 10 in position.

Figures 17, 18, 19:
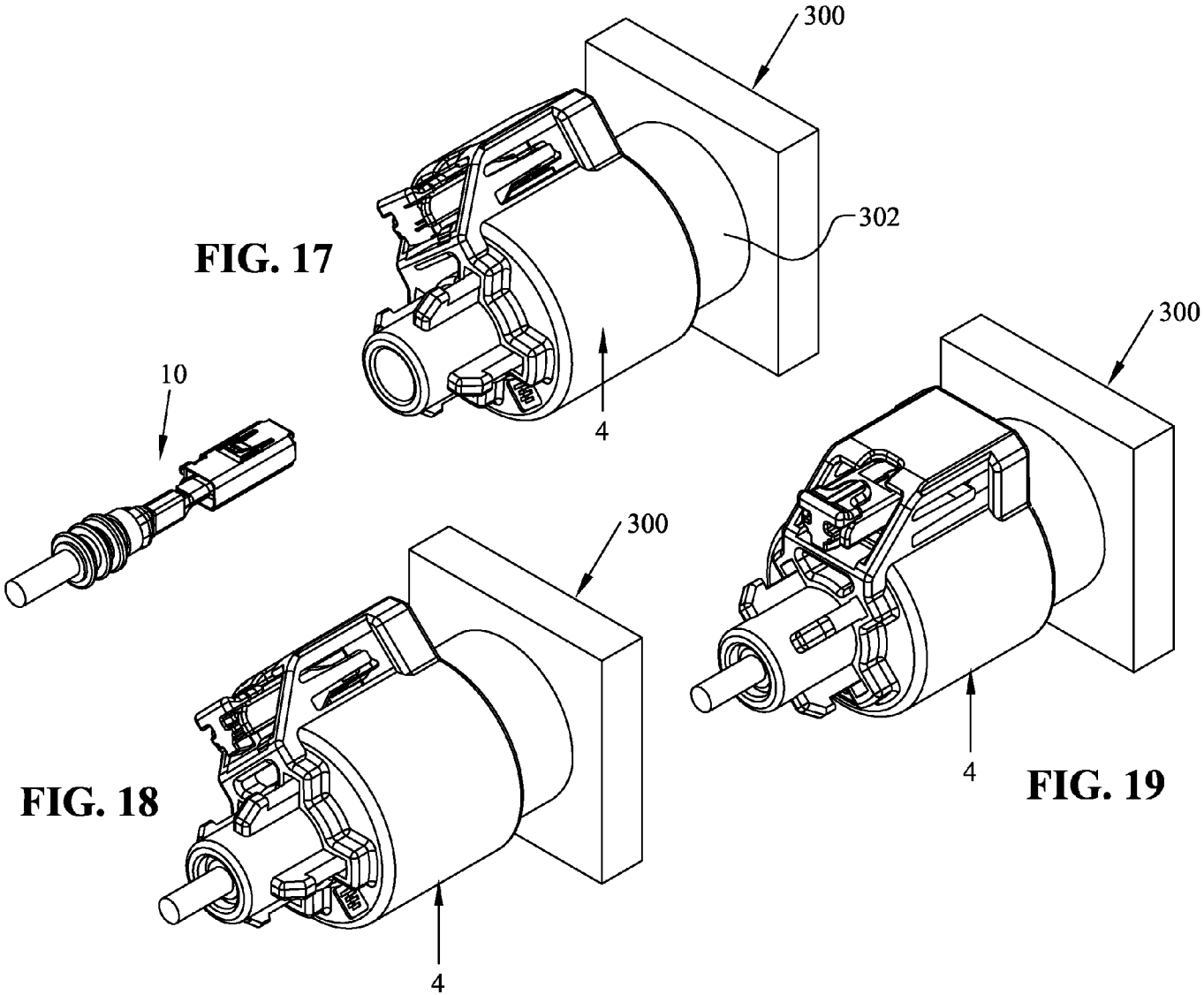
FIGS. 17-19 show an assembly process for the connector assembly.

With respect to FIGS. 17-19, the relative rotation of main housing portion 4 and front housing portion 8 may be carried out by way of a fixture 300. The connector assembly as assembled into the configuration of FIG. 14 may be placed over a post 302 of fixture 300, which retains front housing portion 8 in position as shown in FIG. 17. Terminal 10 may be positioned into main housing portion 4 as described above. With the terminal fully positioned in main housing portion 4 and front housing portion 8 (corresponding to the position depicted in FIG. 16) main housing portion 4 may be rotated from the position shown in FIG. 18, to the fully locked position of FIG. 19.

It should be appreciated from a review of FIG. 16 that housing 2 may also be sealed using the configuration of secondary locking described. As shown, a peripheral seal 210 may be positioned over post 40 and be held in place by rear face 124. Mating connector 300 would interface with seal 210 to provide a sealed front end, while the rear wire seal 198 would seal the rear of the assembly.

It should also be understood that while a single position connector assembly is shown that multi-position connectors are envisioned by the above description. First, an alternate main housing portion could include multiple terminal receiving passageways 80 and terminal receiving apertures 72, where a plurality of individual front housing portions 8 are individually attached as described above. Alternatively, a front housing portion could include multiple terminal receiving cavities 150, and discrete main housing portions each having terminal receiving passageways 80 and terminal receiving apertures 72 could be individually rotatable to the plurality of terminal receiving cavities 150.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An electrical connector assembly, comprising:

a main housing portion having a terminal receiving passageway therethrough;

a front housing portion having a terminal receiving cavity therein; and an electrical terminal receivable through the terminal receiving passageway and receivable into the terminal receiving cavity;

the main housing portion and the front housing portion being rotatably movable relative to each other causing an overlap of the terminal receiving passageway and the terminal receiving cavity, the main housing portion having a post surrounding the terminal receiving passageway and the front housing portion coupling to an internal portion of the post.

2. The electrical connector of claim 1, wherein the terminal receiving passageway and the terminal receiving cavity have complementary cross sections.

3. The electrical connector of claim 2, wherein the terminal receiving passageway and the terminal receiving cavity have rectangular cross sectional openings.

4. The electrical connector of claim 3, wherein the electrical terminal has a rectangular base portion receivable through the terminal receiving passageway and into the terminal receiving cavity.

5. The electrical connector of claim 3, wherein the electrical connector is a single position connector, and the main housing portion and the front housing portion rotate relatively along a longitudinal centerline, causing the sides of the terminal receiving passageway to overlap the corners of the terminal receiving cavity.

6. The electrical connector of claim 1, further comprising a seal positioned around the main housing post.

7. The electrical connector of claim 6, wherein the seal is positioned around the main housing post at a position adjacent the coupling point of the main housing portion and the front housing portion.

8. An electrical connector assembly, comprising:

a main housing portion having a terminal receiving passageway therethrough; and a front housing portion;

the main housing portion and the front housing portion being coupled to each other and rotatably movable relative to each other causing an overlap of the terminal receiving passageway and the front housing portion, providing a secondary lock for a terminal, and a seal positioned around the main housing portion adjacent the coupling point of the main housing portion and the front housing portion.

9. The electrical connector of claim 8, wherein the front housing portion is positioned forward of the main housing portion.

10. The electrical connector of claim 8, wherein the front housing portion has a terminal receiving cavity therein and the terminal receiving passageway has a terminal receiving aperture therethrough.

11. The electrical connector of claim 10, wherein the main housing portion and the front housing portion rotate along a longitudinal centerline, causing the sides of the terminal receiving aperture to overlap the corners of the terminal receiving cavity.

12. The electrical connector of claim 11, wherein the terminal receiving aperture and the terminal receiving cavity have rectangular cross sectional openings.

13. The electrical connector of claim 12, wherein the electrical terminal has a rectangular base portion receivable through the receiving passageway, the terminal receiving aperture and into the terminal receiving cavity.

14. A single position electrical connector assembly, comprising:

a main housing portion having a terminal receiving passageway therethrough; and a front housing portion having a terminal receiving cavity therein, longitudinally aligned with the terminal receiving passageway;

the main housing portion and the front housing portion being rotatably movable relative to each other causing an overlap of the terminal receiving passageway and the terminal receiving cavity, providing a secondary lock for a terminal, the main housing portion having a post surrounding the terminal receiving passageway, and a seal positioned around the main housing post.

15. The electrical connector of claim 14, wherein the terminal receiving passageway leads into a terminal receiving aperture which is coincident with the terminal receiving cavity.

16. The electrical connector of claim 15, wherein the terminal receiving aperture and the terminal receiving cavity have rectangular cross sectional openings.

17. The electrical connector of claim 16, wherein the main housing portion and the front housing portion rotate along a longitudinal centerline, causing the sides of the terminal receiving aperture to overlap the corners of the terminal receiving cavity.

18. The electrical connector of claim 14, wherein the electrical terminal has a rectangular base portion receivable through the receiving passageway and the terminal receiving cavity.

* * * * *